United States Patent [19]
McCoy et al.
[11] 4,404,096
[45] Sep. 13, 1983

[54] DEMULSIFICATION OF BITUMEN EMULSIONS USING IONENES

[75] Inventors: David R. McCoy; Edward E. McEntire, both of Austin, Tex.

[73] Assignee: Texaco, Inc., White Plains, N.Y.

[21] Appl. No.: 326,459

[22] Filed: Dec. 2, 1981

[51] Int. Cl.[3] ..... C10G 33/04

[52] U.S. Cl. ..... 208/188; 210/708; 210/728; 210/735; 252/358

[58] Field of Search ..... 208/188; 252/358; 210/708, 735, 728

[56] References Cited

U.S. PATENT DOCUMENTS 3,928,448 12/1975 Ballweber et al. ..... 564/291
3,956,117 5/1976 Bradley et al. ..... 252/358
4,038,318 7/1977 Tai ..... 564/286

*Primary Examiner*—Delbert E. Gantz
*Assistant Examiner*—Helane E. Maull
*Attorney, Agent, or Firm*—Jack H. Park; Kenneth R. Priem; David L. Mossman

[57] ABSTRACT

A process for recovering bitumen from oil-in-water (O/W) emulsions is disclosed wherein water soluble demulsifiers are used. These demulsifiers are ionenes prepared generally by reaction of ditertiary amines and dihalides. To resolve the bituminous petroleum emulsions, the process is carried out between 25° and 160° C. wherein the demulsifier of the invention is contacted with the bituminous emulsion.

6 Claims, No Drawings

DEMULSIFICATION OF BITUMEN EMULSIONS USING IONENES

BACKGROUND OF THE INVENTION

1. Field of the Invention

This invention is concerned with the breaking or resolution of oil-in-water (O/W) bituminous emulsions by treatment with ionenes.

2. Description of Related Art

A great volume of hydrocarbons exist in known deposits of tar sands. These deposits occur at various places, the Athabasca tar sands in Canada being an example. The petroleum in a tar sand deposit is an asphaltic bitumen of a highly viscous nature ranging from a liquid to a semi-solid. These bituminous hydrocarbons are usually characterized by being very viscous or even non-flowable under reservoir conditions by the application of driving fluid pressure.

Where surface mining is not feasible, the bitumen must be recovered by rendering the tar material mobile in-situ and producing it through a well penetrating the tar sand deposit. These in-situ methods of recovery include thermal, both steam and in-situ combustion and solvent techniques. Where steam or hot water methods are used, a problem results which aggravates the recovery of the bitumen. The difficulty encountered is emulsions produced by the in-situ operations. These emulsions are highly stable O/W emulsions which are made even more stable by the usual presence of clays. Most *liquid* petroleum emulsions are water-in-oil (W/O) types. These normal W/O emulsions are broken by methods known in the art. However, the bitumen emulsions which are O/W types present a much different problem, and the same demulsifiers used in W/O emulsions will not resolve the O/W bitumen emulsions.

A. C. W. W. Gewers, *J. Canad. Petrol. Tech.* 7(2), 85–90 (1968) describes the uniqueness of bitumen emulsions.

B. U.S. Pat. No. 3,928,448 claims an ionene for solids removal from water. O/W emulsion breaking is also mentioned.

C. U.S. Pat. No. 3,956,117 discloses the use of the same ionene as in B in breaking O/W emulsions, specifically oily water water emulsions.

D. U.S. Pat. No. 4,038,318 discloses the use of a three-dimensional ionene prepared from a dihalo compound and a Mannich base in breaking O/W emulsions.

SUMMARY OF THE INVENTION

The invention is a method for recovering petroleum from O/W bitumen emulsions by resolving or breaking these emulsions by contacting the emulsions at a temperature of from between about 25° and 160° C. with ionenes prepared generally by reaction of ditertiary amines and dihalides (or alternatively by homopolymerization of dialkylaminoalkyl halides) and having the general structure

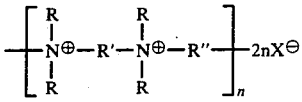

where the identity of the terminating groups is not critical but is generally a tertiary amine or organo halo group and wherein R′ and R″ equal alkylene groups which may contain carbon-carbon unsaturation, cyclo aliphatic groups, ethers, amides and urea linkages and wherein R is generally a lower alkyl such as $CH_3$ or $CH_2CH_2OH$ and wherein R-N-R′-N may constitute part of a heterocyclic system, and X is an anion, usually a halide. Also, the compounds to be used as demulsifiers must have an average molecular weight greater than about 2,000 and the presence of greater than 5 meq/g quaternary amine in the neat polymer.

DESCRIPTION OF THE PREFERRED EMBODIMENTS

Useful in this process are ionenes prepared generally by reaction of ditertiary amines and dihalides (or alternatively by homopolymerization of dialkylaminoalkyl halides) and having the general structure

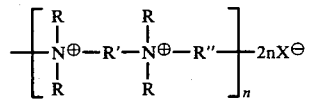

where the identity of the terminating groups is not critical but is generally a tertiary amine or organo halo group and wherein R′ and R″ equal alkylene groups which may contain carbon-carbon unsaturation, cyclo aliphatic groups, ethers, amides and urea linkages and wherein R is generally a lower alkyl such as $CH_3$ or $CH_2CH_2OH$ and wherein R-N-R′-N may constitute part of a heterocyclic system, and X is an anion, usually a halide. Also, the compounds to be used as demulisifiers must have an average molecular weight greater than about 2,000 and the presence of greater than 5 meq/g quaternary amine in the neat polymer.

Especially preferred in the process of this invention is an ionene of the above description having a molecular weight greater than or equal to about 10,000 and the presence of greater than about 6.7 meq/g quaternary amine in the neat polymer.

Also especially preferred specific compounds for use as demulsifiers in this invention are those where the dihalo compound is 1,4-dichloro-2-butene and the diamine is chosen from (a) N,N′-dimethylpiperazine, (b) bis(dimethylaminopropyl)urea, or (c) 1,4-diazobicyclo(2.2.2)octane.

The produced bitumen emulsions may be treated by the process of our invention in a conventional manner, for example, in a conventional horizontal treater operated, for example, from about 25° to 160° C. and, preferably, from about 50°–150° C. at autogenous pressures. The concentration of the chemical demulsifier described above used in treating the bitumen in water emulsions may range from about 1 to 200 parts per million and, preferably, from about 10 to 150 parts per million with the optional addition of an organic diluent and/or inorganic salt as well as standard flocculants and mechanical or electrical means of demulsification. The following examples describe more fully the present process. However, these examples are given for illustration and are not intended to limit the invention.

EXAMPLE A

Preparation of Ionenes in Dmf/Methanol at Room Temperature

The general procedure was to dissolve the ditertiary amine in 30 ml of a 50:50 (vol:vol) mixture of methanol and dimethylformamide, charge the solution to a one-neck flask, add slowly a solution of dihalo compound in 30 ml of this solvent (washing in residue with an additional 5 ml DMF/methanol portion), and stirr at atmospheric pressure until any exotherm was complete. If product precipitated out upon standing, the reaction mixture was filtered, washing the filter cake with a trace of DMA/methanol followed by larger amounts of acetone. Solids were then dried at 1 mm pressure and room temperature. If no precipitation occurred on several days standing, the reaction mixture was analyzed as is. For molecular weight determinations liquid chromatographic analyses were carried out on size-exclusion silica columns modified with organic diamine functionalities. Solvent for analyses was 0.1 N $HNO_3$ and calibration was by use of polyacrylamide and poly(oxyethylene)glycol standards of known molecular weight.

1. N,N,N',N'-tetramethylethylenediamine (11.6 g) and trans-1,4-dichloro-2-butene (12.5 g) were the reactants. Solids were filtered and dried after 68 hours. Product analyzed for 8.3 meq/g total amine and 8.26 meq/g quaternary amine and hplc gave a molecular weight of <1,000.

2. N,N,N',N'-tetramethylethylenediamine (11.6 g) and α,α'-dichloro-p-xylene (17.5 g) were the reactants. After 68 hours the reaction mass was triturated with acetone and dried to obtain a solid product analyzing for 4.19 meq/g total amine (calculates to 61 wt.% polymer) and 4.05 meq/g quaternary amine. Hplc showed a molecular weight of 16,500.

3. N,N,N',N'-tetramethyl JEFFAMINE ® ED-600* (32.1 g) and trans-1,4-dichloro-2-butene (6.3 g) were the reactants and no solvent was employed other than 30 ml initially charged DMF/methanol. No precipitate occurred on several weeks standing. Hplc showed a polymer molecular weight of 11,000.

*JEFFAMINE ED-600 is a product of Texaco Chemical Co. having the structure:

$$O[(CH_2CH_2O)_{4.35}(CH_2\underset{\underset{CH_3}{|}}{C}HO)_{0.75}CH_2\underset{\underset{CH_3}{|}}{C}HNH_2]_2$$

4. N,N'-dimethylpiperazine (11.4 g) and trans-1,4-dichloro-2-butene (12.5 g) were the reactants and only 30 ml solvent was employed. Solids were removed and dried after 24 hours reaction period. Polymer analyzed for 9.68 meq/g total amine and 5.34 meq/g quaternary amine. Hlpc showed a polymer molecular weight of 1,400.

5. Procedure of Example 4 above was repeated using 17.5 g α,α'-dichloro-p-xylene as the dihalo component. Solid polymer contained 5.82 meq/g total amine (6.92 theory) and 5.27 meq/g quaternary amine. Molecular weight was 2,300.

6. N,N,N',N'-tetramethyl-1,3-propanediamine (13 g) and trans-1,4-dichloro-2-butene (12.5 g) were the reactants. Solids isolates after six days analyzed for 4.98 meq/g total amine (63.5 wt.% polymer present) and 4.76 meq/g quaternary amine; molecular weight was 11,500.

7. N,N,N',N'-tetramethyl-1,6-hexanediamine (12 g) and trans-1,4-dichloro-2-butene (8.7 g) were the reactants. Solids isolated after three days analyzed for 3.51 meq/g total amine (52 wt.% polymer) and 3.31 meq/g quaternary amine; molecular weight was 7,400.

8. Bis-(dimethylaminopropyl)urea (21.6 g) and trans-1,4-dichloro-2-butene (12.5 g) were the reactants. No precipitation occurred after several weeks at room temperature. Hplc showed a product molecular weight of 10,000.

9. Procedure of Example 8 above was repeated with 17.5 g α,α'-dichloro-p-xylene as the halo compound to obtain a solution of polymer having a molecular weight of 12,500.

10. 1,4-Diazobicyclo(2.2.2)octane (11.2 g) and trans-1,4-dichloro-2-butene (12.5 g) were the reactants. Polymer isolated after three days contained 5.95 meq/g total amine (70.5% actives) and 5.92 meq/g quaternary amine and had a molecular weight of 2,600.

11. N,N,N',N'-tetramethyl JEFFAMINE D-230** (14.3 g) and trans-1,4-dichloro-2-butene (6.3 g) were the reactants. No exotherm occurred upon mixing, so mixture was refluxed for 1½ hours. The clear product solution was analyzed by Hplc and polymer shown to have a molecular weight of 3,700.

**JEFFAMINE D-230 is a product of Texaco Chemical Company having the structure $$H_2N\underset{\underset{CH_3}{|}}{C}HCH_2(O\underset{\underset{CH_3}{|}}{C}HCH_2)_{1.5-2.0}OCH_2\underset{\underset{CH_3}{|}}{C}HNH_2$$

12. Procedure 11 above was repeated using 8.7 g α,α'-dichloro-p-xylene as the dihalo component. Hplc analysis of product solution showed a molecular weight of 6,900 for the polymer.

13. N,N,N',N'-tetramethyl-1,3-propanediamine (13 g) and 1,2-bis(2-chloroethoxy)ethane (8.7 g) were the reactants. No precipitate formed after several weeks standing. Polymer molecular weight was shown to be 1,500.

EXAMPLE B

Preparation of Ionenes in $H_2O$ Solvent

1. A three-neck 250-ml round bottom flask was charged with 50 g of $H_2O$ and 11.6 g N,N,N',N'-tetramethyl-1,2-ethylenediamine. Added from dropping funnel over 50 minutes with magnetic stirring was 12.4 g of trans-1,4-dichloro-2-butene. At the end of addition, the reaction mixture was refluxed for two hours to obtain a clear solution analyzing for 2.7 meq/g total amine and 2.67 meq/g quaternary amine with polymer molecular weight of 10,800.

2. Repeated procedure of B1 using 11.4 g N,N'-dimethylpiperazine and 12.5 g trans-1,4-dichlorobutene. The solution contained 2.66 meq/g total amine (31.7% polymer) and 2.61 meq/g quaternary amine with polymer molecular weight of 10,000.

3. Repeated B1 using 12 g N,N,N',N'-tetramethyl-1,6-hexanediamine and 8.7 g trans-1,4-dichloro-2-butene with a 5-hour reflux period. The solution analyzed for 2.09 meq/g amine (31.2% polymer) with 2.0 meq/g quaternary amine. Polymer molecular weight was 4,500.

EXAMPLE C

1. The general method employed in testing the products of Examples A and B is described as follows:

a. A 1 wt.% solution of each chemical was prepared in water.

b. A 30 ml PYREX ® test tube equipped with screw top was charged with 23 ml emulsion of 11.5 weight percent bitumen content obtained by in-situ steam flooding in tar sand pattern located at Ft. McMurray, Alberta, Canada.

c. 2 ml Wizard Lake crude oil was added as diluent and the contents of the test tube were mixed.

d. The contents of the test tube were equilibrated in a 80° C. oven for 1–2 hours and mixed again.

e. Chemical was added to the hot, dilute emulsion at the following concentrations: 60, 120 ppm.

f. Contents of the test tubes were mixed, reequilibrated in an oven at 80° C. for 1 hour and mixed again.

g. After 20 hours of standing at 80° C., measurements were made on the volume of top and middle layers, and the appearance of the aqueous phase was noted. Samples of some top layers were carefully removed by pipetting and subjected to Karl-Fischer analysis for determination of the water content.

The results are summarized in the attached tables for compounds of Examples A and B as well as for POLYBRENE® (tradename for 6,3-ionene bromide) and POLYOX, a commercial 4,000,000 molecular weight poly(ethylene oxide). Examples of good demulsification are given in C3, 6, 8, 10, 13, 19 and 22. Examples of borderline activity are given in C 9, 17 and 20. Examples of ionenes falling outside the desired specifications giving poor or no demulsification are given in C1, 4, 5, 11, 13, 14 and 16.

DEMULSIFIER TESTING

| Example C | Candidate Demulsifier | Concentration, ppm | Oil Phase Vol in ml (% $H_2O$) | | Emulsion Phase Vol in ml (% $H_2O$) | Aqueous Phase Appearance |
|---|---|---|---|---|---|---|
| 1 | Product of Example A1 | 120 | 2 | | 3 | Muddy |
| 2 | Product of Example A2 | 60 | 10.5 | (89) | 0 | Muddy |
| 3* | Product of Ex. A2 | 120 | 8 | (49) | 0 | Colorless, clear |
| 4 | Product of Ex. A3 | 120 | 2.5 | | 5 | Muddy with bitumen chunks |
| 5 | Product of Ex. A4 | 120 | 2.5 | | 5.5 | Muddy |
| 6* | Product of Ex. A5 | 120 | 8.5 | (15) | 0 | Colorless, clear |
| 7 | Product of Ex. A6 | 60 | 8 | (28.6) | 0 | Just translucent |
| 8* | Product of Ex. A6 | 120 | 7 | (1.5) | 0 | Colorless, clear |
| 9 | Product of Ex. A7 | 120 | 6 | (28) | 0.5 | Dark, muddy |
| 10* | Product of Ex. A8 | 120 | 6 | (7.2) | 0 | Colorless, clear |
| 11 | Product of Ex. A9 | 120 | 2 | | 6.5 | Muddy with bitumen chunks |
| 12 | Product of Ex. A10 | 60 | 5 | (41) | 2 | Almost translucent |
| 13* | Product of Ex. A10 | 120 | 7 | (8.4) | 0 | Colorless, clear |
| 14 | Product of Ex. A11 | 120 | 1.5 | | 7.5 | Muddy with bitumen chunks |
| 15 | Product of Ex. A12 | 120 | 1 | | 7 | Light brown with bitumen chunks |
| 16 | Product of Ex. A13 | 120 | 3 | | 1 | Muddy |
| 17 | Product of Ex. B1 | 120 | 9 | (48) | 0 | Translucent |
| 18 | Product of Ex. B2 | 60 | 9 | (93.8) | 0 | Dark, translucent |
| 19* | Product of Ex. B2 | 120 | 6 | (13) | 0 | Colorless, clear |
| 20 | Product of Ex. B3 | 120 | 8.5 | (43.7) | 0 | Colorless, clear with bitumen chunks |
| 21 | POLYBRENE | 60 | 8.5 | (83) | 0 | Muddy with bitumen chunks |
| 22* | POLYBRENE | 120 | 6 | (2.8) | 1.5 | Colorless, clear |
| 23 | POLYOX** | 60 | 6–8 | (44–92) | 0.5–3 | Translucent |
| 24 | POLYOX** | 120 | 6–7.5 | (49–96) | 0.5–1.0 | Translucent |
| 25 | None** | — | 1.5–2 | | 2–2.5 | Muddy |

*Emulsion broke immediately upon addition of demulsifier to give clear aqueous layer
**Range of results of multiple runs given

We claim:

1. A process for recovering petroleum from O/W bitumen emulsions by demulsifying said emulsions comprising contacting the emulsions at a temperature of from between about 25° and 160° C. with ionenes having the general structure

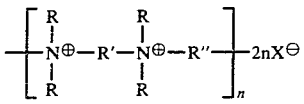

where the identity of the terminating groups is a tertiary amine or organo halo group, wherein R′ and R″ equal alkylene groups, cyclo aliphatic groups, ethers, amides and urea linkages and wherein R is a lower alkyl, X is an anion, and wherein the ionene has an average molecular weight greater than about 2,000 and the presence of greater than 5 meq/g quaternary amine in the neat polymer.

2. A process as in claim 1 wherein the average molecular weight is greater than about 10,000.

3. A process as in claim 1 wherein the quaternary amine content in the neat polymer is greater than about 6.7 meq/g.

4. A process for recovering petroleum from O/W bitumen emulsions by demulsifying said emulsions by adding thereto demulsifiers comprising ionenes prepared from the reaction of 1,4-dichloro-2-butene with N,N′-dimethylpiperazine wherein the average molecular weight of the reaction product is greater then about 2,000.

5. A process for recovering petroleum from O/W bitumen emulsions by demulsifying said emulsions by adding thereto demulsifiers comprising ionenes which are the reaction product of 1,4-dichloro-2-butene and bis(dimethylaminopropyl)urea and wherein the average molecular weight of the reaction product is greater than about 2,000.

6. A process for recovering petroleum from O/W bitumen emulsions by demulsifying said emulsions by adding thereto demulsifiers comprising ionenes which are the reaction product of 1,4-dichloro-2-butene and 1,4-diazobicyclo(2.2.2)octane and wherein the average molecular weight of the reaction product is greater than about 2,000.

* * * * *